US008661629B2

(12) United States Patent
Wang

(10) Patent No.: US 8,661,629 B2
(45) Date of Patent: Mar. 4, 2014

(54) ROLLER-LOADED ZIPPER SLIDE

(71) Applicant: Genmore Zipper Corporation, New Taipei (TW)

(72) Inventor: Lien-Chou Wang, New Taipei (TW)

(73) Assignee: Genmore Zipper Corporation, New Taipei (TW)

( * ) Notice: Subject to any disclaimer, the term of this patent is extended or adjusted under 35 U.S.C. 154(b) by 0 days.

(21) Appl. No.: 13/709,459

(22) Filed: Dec. 10, 2012

(65) Prior Publication Data

US 2013/0097820 A1 Apr. 25, 2013

Related U.S. Application Data

(63) Continuation-in-part of application No. 13/014,038, filed on Jan. 26, 2011, now Pat. No. 8,381,369.

(51) Int. Cl.
*A44B 19/26* (2006.01)

(52) U.S. Cl.
USPC ..... 24/415

(58) Field of Classification Search
CPC ..... B65D 33/2591; F16G 11/10
USPC ..... 24/415, 417, 430, 427, 429; 383/64
See application file for complete search history.

(56) References Cited

U.S. PATENT DOCUMENTS

| | | | | | |
|---|---|---|---|---|---|
| 1,703,712 | A * | 2/1929 | Aud | 383/64 |
| 3,189,038 | A * | 6/1965 | Von Pechmann | 137/315.07 |
| 3,919,745 | A * | 11/1975 | Dupon | 24/424 |
| 5,081,747 | A * | 1/1992 | Takizawa et al. | 24/415 |
| 6,026,546 | A * | 2/2000 | Lund et al. | 24/431 |
| 7,219,402 | B2 * | 5/2007 | Yamazaki | 24/429 |
| 7,416,339 | B2 * | 8/2008 | Plourde et al. | 383/64 |
| 7,464,445 | B1 * | 12/2008 | Lin | 24/415 |
| 7,650,674 | B2 * | 1/2010 | Miyazaki et al. | 24/424 |
| 2012/0117709 | A1 * | 5/2012 | Damon et al. | 2/85 |
| 2012/0117766 | A1 * | 5/2012 | Damon et al. | 24/415 |

* cited by examiner

*Primary Examiner* — Robert J Sandy
*Assistant Examiner* — Rowland D Do
(74) *Attorney, Agent, or Firm* — Jackson IPG PLLC

(57) ABSTRACT

A roller-loaded zipper slide includes first and second roller brackets respectively mounted in top and bottom slide body blocks of the slide body thereof to carry a respective front roller in flush with the front edges of the top and bottom slide body blocks and in proximity to the zipper's interlocking teeth and in direct contact with the zipper tapes for guiding the interlocking teeth into the internal chamber of the roller-loaded zipper slide smoothly and accurately, avoiding scratching or damaging the stitches of the zipper tapes, improving zipper slide sliding mobility, reducing zipper teeth wear and prolonging zipper slide lifespan.

9 Claims, 16 Drawing Sheets

ROLLER-LOADED ZIPPER SLIDE

CROSS REFERENCE TO RELATED APPLICATION

This Invention is a continuation-in-part of U.S. Ser. No. 13/014,038, entitled "Roller Zipper Slide" filed on Jan. 26, 2011 and currently pending.

BACKGROUND OF THE INVENTION

1. Field of the Invention

The present invention relates to zippers and more particularly, to a roller-loaded zipper slide for zip fastener, which has a roller bracket mounted in the top slide body block of the slide body thereof to carry a front roller in flush with the front edge of the top slide body block and in proximity to the zipper's interlocking teeth and in direct contact with the zipper tapes for guiding the interlocking teeth into the internal chamber of the roller-loaded zipper slide smoothly and accurately, avoiding scratching or damaging the stitches of the zipper tapes, improving zipper slide sliding mobility, reducing zipper teeth wear and prolonging zipper slide lifespan.

2. Description of the Related Art

When pulling the pull tab 6 to move the conventional zipper slide 5 along the zipper tapes 50 of a conventional zip fastener, as shown in FIG. 1, the pulling direction A1 of the pull tab 6 and the moving direction A2 of the zipper slide 5 is normally not kept in parallel, a downward pressure will be rendered to the zipper slide 5 against the zipper tapes 50 subject to the law of the lever, causing the front bottom edge 511 of the top slide body block 51 of the zipper slide 5 to rub against the stitches (not shown) at the surfaces 501 of the zipper tapes 50. After a long use, the stitches can be broken, causing zipper teeth to spread apart. If this design of zip fastener is used in a bag, the aforesaid problem will become more serious.

SUMMARY OF THE INVENTION

The present invention has been accomplished under the circumstances in view. It is the main object of the present invention to provide a roller-loaded zipper slide for zip fastener, which comprises at least one roller bracket each carrying a front roller. When attaching the roller-loaded zipper slide to the zipper tapes of a single layer or double-layer zipper, the front roller of each roller bracket is kept in proximity to the zipper's interlocking teeth and in direct contact with the zipper tapes to guide the interlocking teeth into the internal chamber of the roller-loaded zipper slide smoothly and accurately, avoiding scratching or damaging the stitches of the zipper tapes, improving sliding mobility, reducing zipper teeth wear and prolonging zipper slide lifespan.

According to another aspect of the present invention, the roller-loaded zipper slide can be assembled subject to a scheduled production. After a purchase order is confirmed, roller brackets can then be installed in respective roller-loaded zipper slides, and then respective pull tabs can be respectively riveted to the crowns of respective roller-loaded zipper slides, enhancing quick delivery capacity.

According to still another aspect of the present invention, front roller and rear rollers can be formed integral with one roller bracket, constituting a roller bracket module for installation in the roller-loaded zipper slide conveniently.

According to still another aspect of the present invention, the front roller and rear roller of the roller bracket are positively secured in position for free rotation, and configured to avoid direct contact with the stitches that are fastened to the zipper tapes to secure the interlocking teeth in place, preventing damaging the stitches.

According to still another aspect of the present invention, front roller, rear rollers and each roller bracket can be made in integrity by die casting, facilitating electroplating and assuring a high level of operating precision.

DETAILED DESCRIPTION OF THE INVENTION

Figure 1:
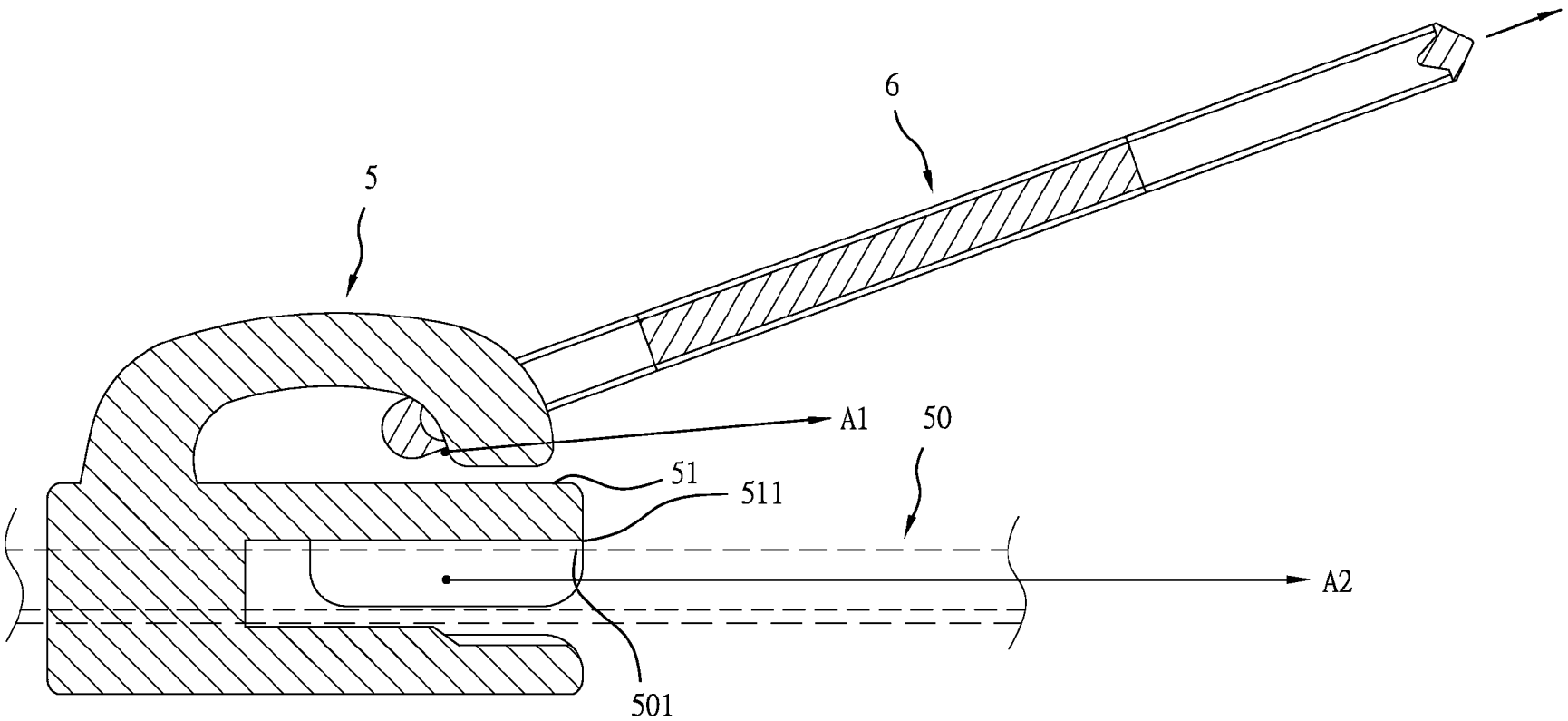
Fig. 1 PRIOR ART
FIG. 1 is an elevational view of a roller zipper slide according to the prior art.
Figure 2:
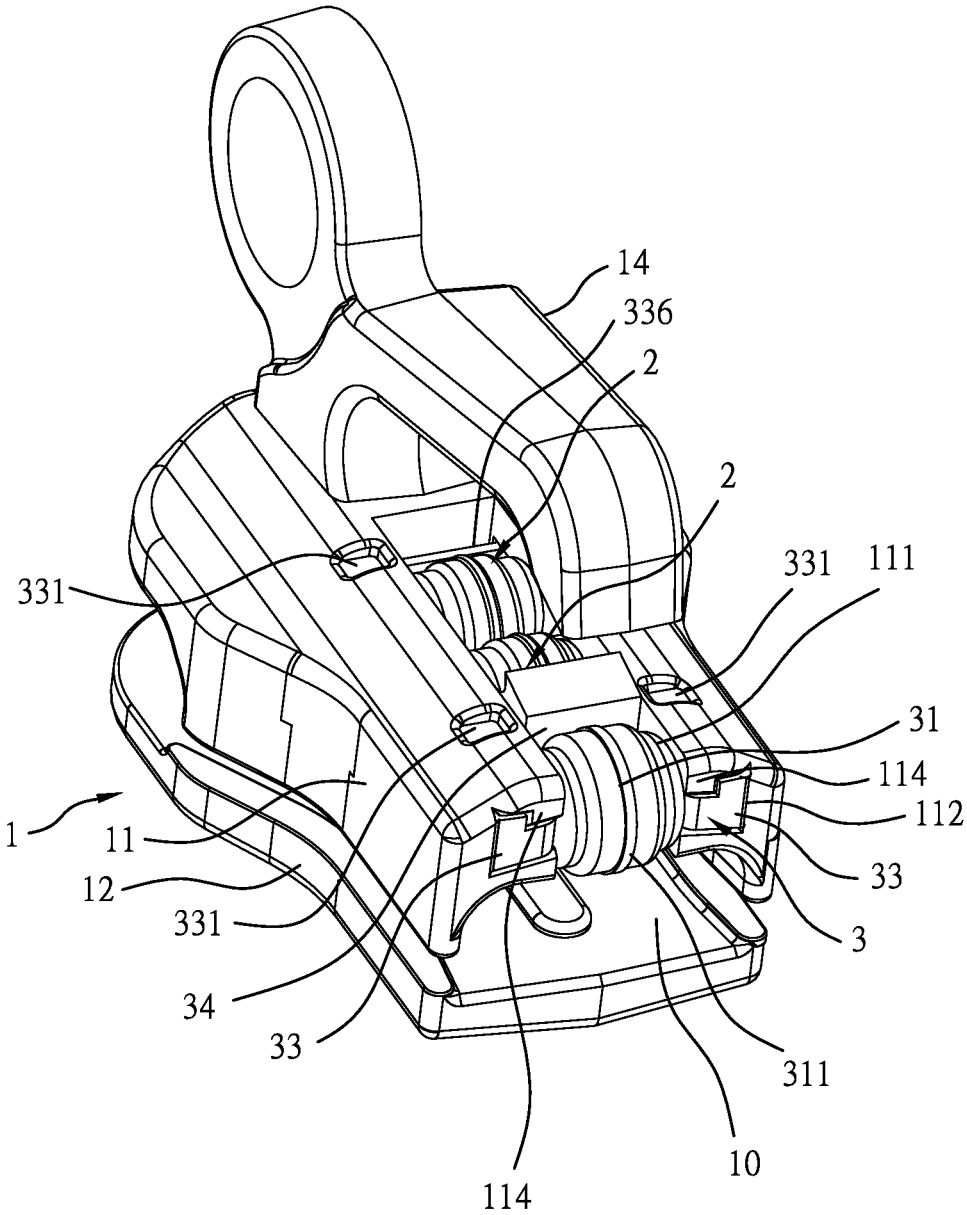
FIG. 2 is an elevational view of a roller-loaded zipper slide in accordance with a first embodiment of the present invention.
Figure 3:
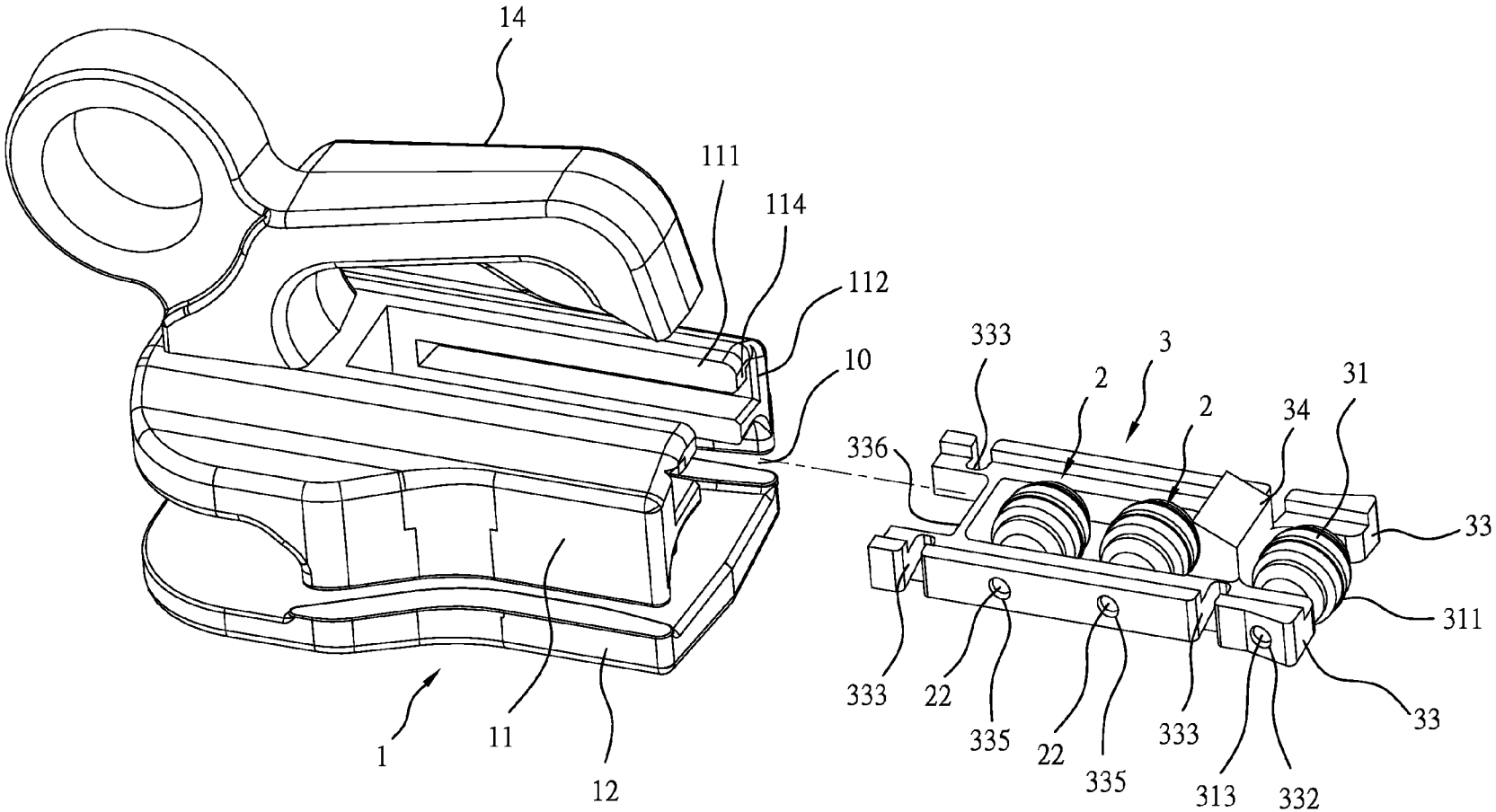
FIG. 3 is an exploded view of the roller-loaded zipper slide in accordance with the first embodiment of the present invention.

Referring to FIGS. 2-7, a roller-loaded zipper slide 1 in accordance with a first embodiment of the present invention is shown. As illustrated, the roller-loaded zipper slide 1 comprises a top slide body block 11, a bottom slide body block 12, a center block 13 connected between the top slide body block 11 and the bottom slide body block 12 (see FIGS. 4 and 6), an internal chamber 10 defined in between the top slide body block 11 and the bottom slide body block 12, and a crown 14 located on the top side of the top slide body block 11 for holding a pull tab 8 (see FIG. 7).

The main features of the roller-loaded zipper slide 1 in accordance with this first embodiment are outlined hereinafter.

A roller bracket 3 is fixedly mounted in the top slide body block 11. The roller bracket 3 comprises a front roller 31 so configured that when the zipper slide 1 is attached to a zipper's zipper tapes 9 (see FIG. 7), the front roller 31 is kept in proximity to the zipper's interlocking teeth 91 and in direct contact with the zipper tapes 9. If the zipper using the roller-loaded zipper slide 1 is installed in a curved area of an object and when the user pulls the pull tab 8 (see FIG. 7) and touches the front end of the crown 14, the rolling motion of the front roller 31 can guide interlocking teeth into the internal chamber 10 of the roller-loaded zipper slide 1. Further, the rolling contact between the front roller 31 and the zipper tapes 9 does not produce much friction resistance, avoiding scratching or damaging the stitches of the zipper tapes 9, improving zipper slide sliding mobility, reducing zipper teeth wear and prolonging zipper slide lifespan.

Further, the front side 311 of the front roller 31 of the roller bracket 3 is approximately kept in flush with or slightly protruding over the front edge 114 of the top slide body block 11 (see FIG. 5), in proximity to the interlocking teeth 91.

Figure 4:
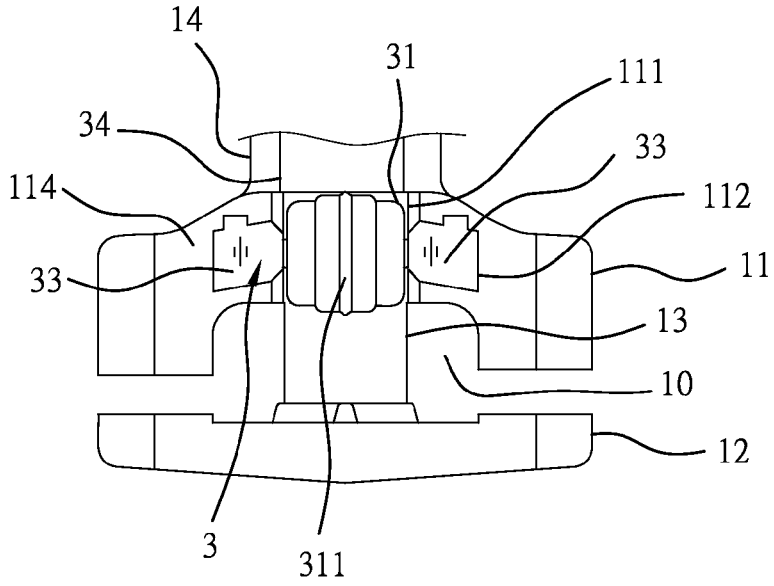
FIG. 4 is a front sectional view of the roller-loaded zipper slide in accordance with the first embodiment of the present invention.
Figure 5:
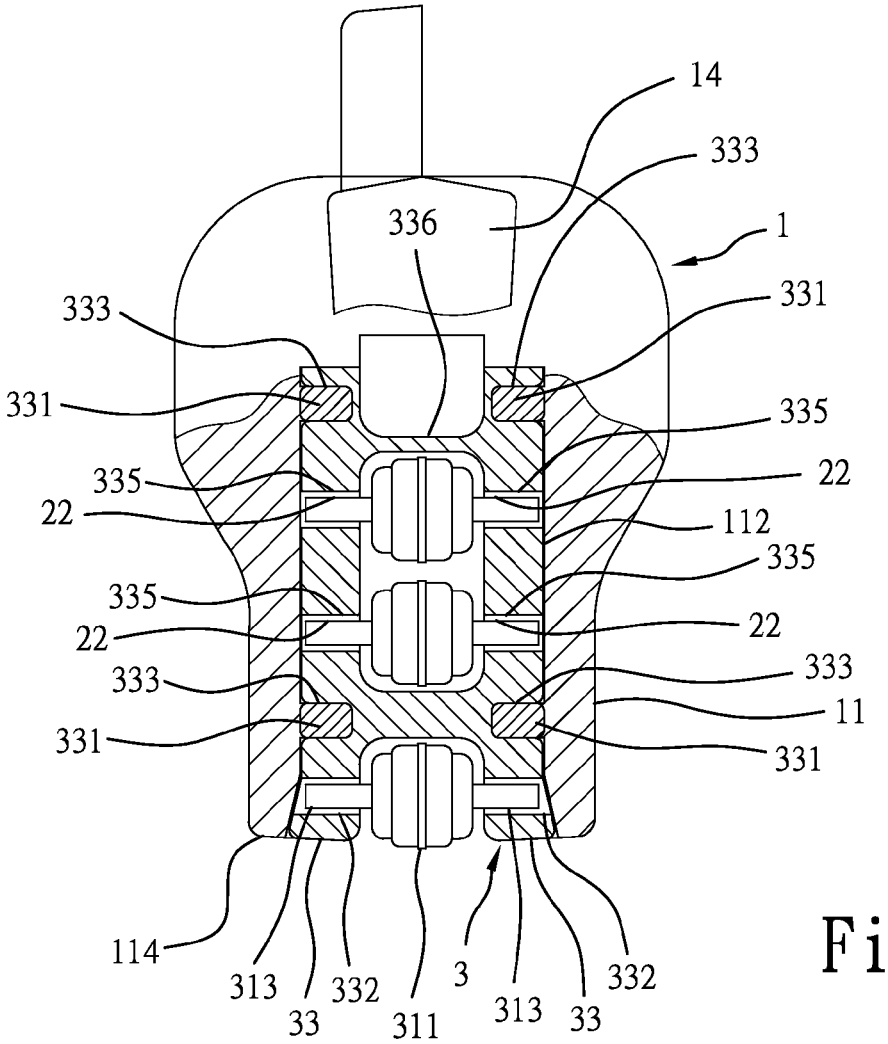
FIG. 5 is a top view, partially in section, of the roller-loaded zipper slide in accordance with the first embodiment of the present invention.
Figure 6:
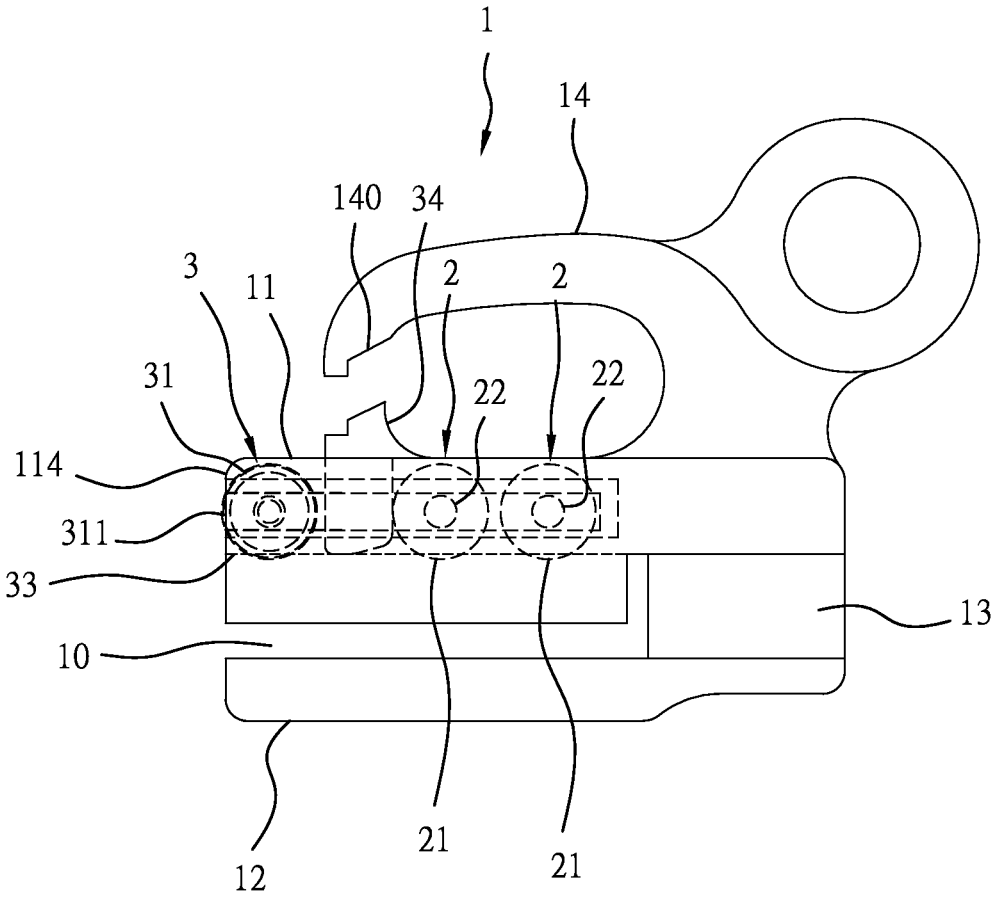
FIG. 6 is a schematic side plain view of the roller-loaded zipper slide in accordance with the first embodiment of the present invention.
Figure 7:
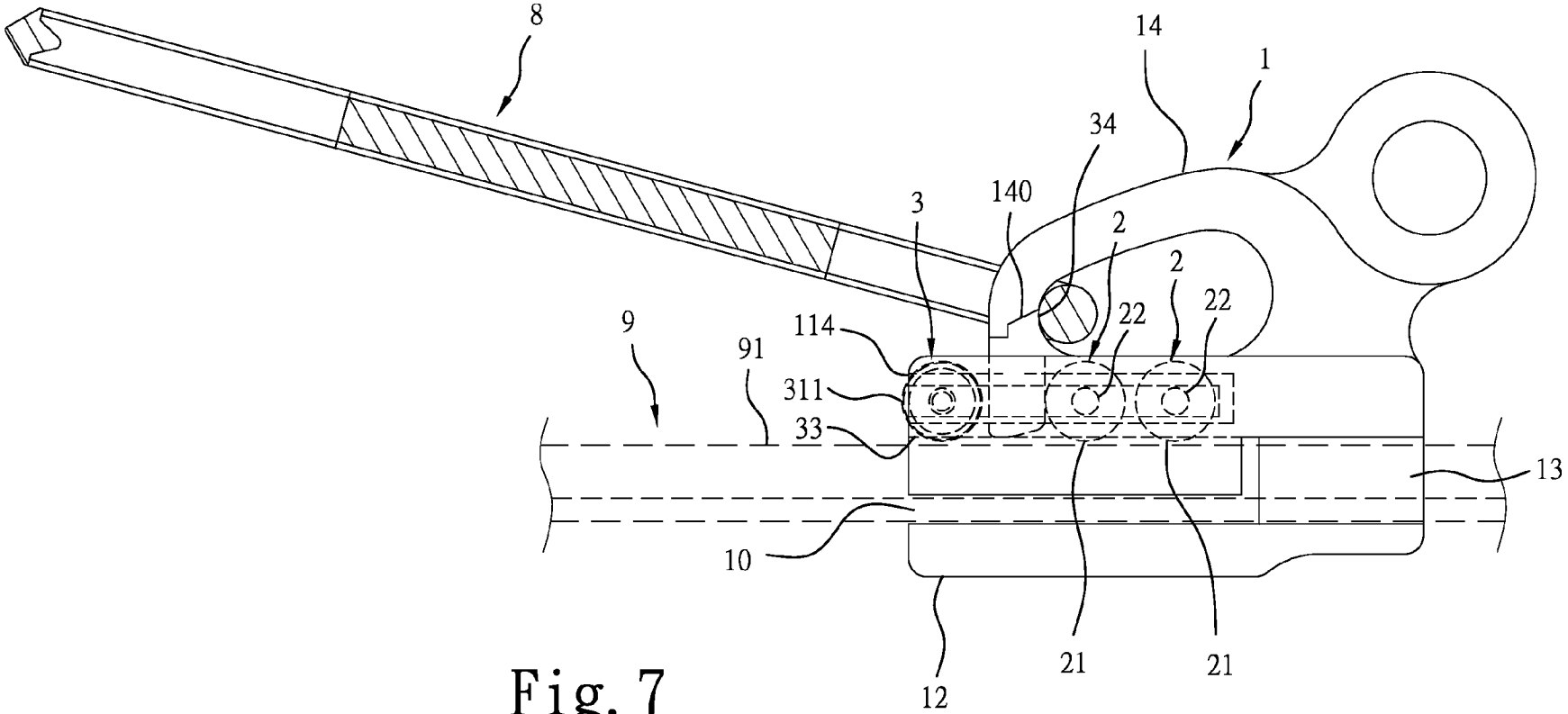
FIG. 7 is a schematic applied view of the first embodiment of the present invention, illustrating a pull tab fastened to the crown and the crown set in position.

Further, in the aforesaid first embodiment, the top slide body block 11 comprises a vertical slot 111 cut through the top and bottom sides thereof on the middle (see FIG. 3) and two coupling grooves 112 located at two opposite lateral sides of the vertical slot 111 (see FIG. 4). Further, the vertical slot 111 is kept in communication with the internal chamber 10. The roller bracket 3 comprises two opposite rails 33 symmetrically disposed at two opposite lateral sides thereof and respectively coupled to the coupling grooves 112 of the top slide body block 11 and then affixed thereto by riveting or any other fastening technique.

The roller bracket 3 further comprises at least one, for example, two rear rollers 2 pivotally arranged in a parallel manner at a rear side relative to the front roller 3. Each rear roller 2 comprises a roller axle 22 pivotally connected between the two opposite rails 33 of the roller bracket 3, and a bottom side 21 slightly projecting into the internal chamber 10 of the roller-loaded zipper slide 1 (see FIG. 6) right above the engaging position between the interlocking teeth 91 of the left and right zipper tapes 9.

Further, the roller bracket 3 comprises a plurality of locating notches 333 symmetrically located at the two opposite rails 33 (see FIGS. 3 and 5) and affixed to the top slide body block 11 of the roller-loaded zipper slide 1 with rivets 331 (see FIGS. 2 and 5) or other fastening members. The roller bracket 3 further comprises a slightly upwardly arched stop block 34 for stopping the pull tab 8 in the crown 14 of the roller-loaded zipper slide 1 after the crown 14 is set into a close position (see FIG. 7).

Further, the roller bracket 3 comprises two front pivot holes 332 and four rear pivot holes 335 symmetrically located at the two opposite rails 33 (see also FIG. 3) for receiving the roller axle 313 of the front roller 31 and the roller axles 22 of the rear rollers 2.

Figure 8:
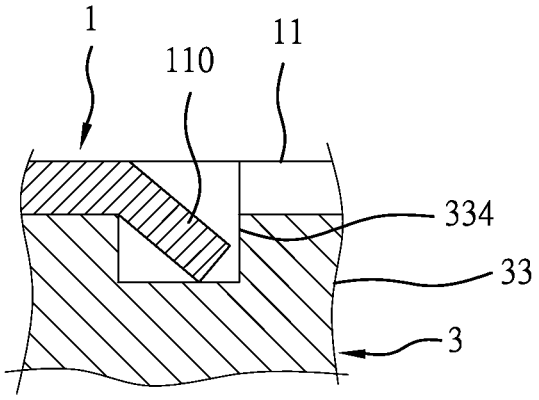
FIG. 8 is a schematic sectional view of a part of a roller-loaded zipper slide in accordance with a second embodiment of the present invention, illustrating the mounting arrangement between a top slide body block and a roller bracket.
Figure 9:
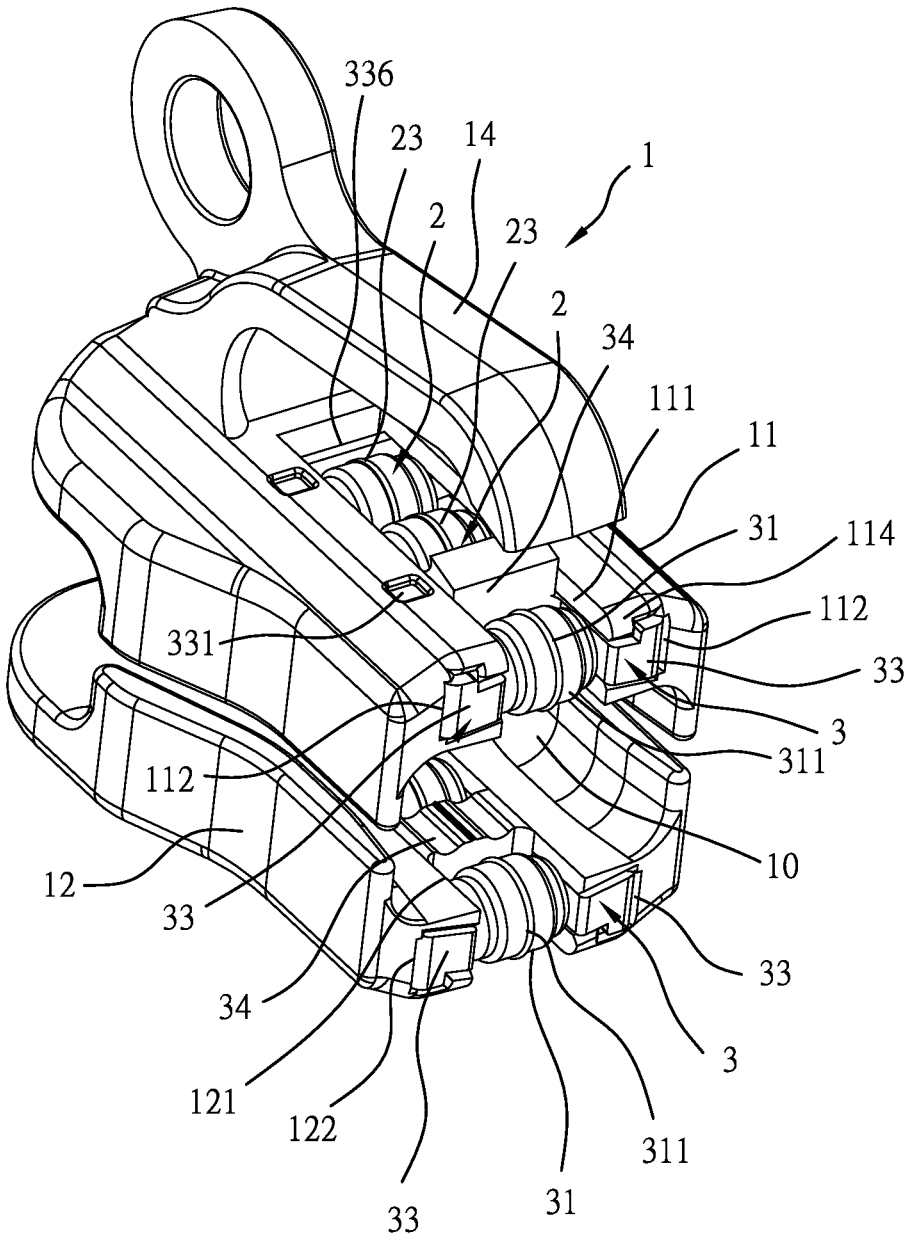
FIG. 9 is an elevational view of a roller-loaded zipper slide in accordance with a third embodiment of the present invention.

Further, in a second embodiment of the present invention, as shown in FIG. 8, roller-loaded zipper slide 1 is characterized in that each rail 33 of the roller bracket 3 comprises a protruding locating portion 110 riveted or stamped into engagement with a respective locating recess 334 at the corresponding rail 33.

Further, the front roller 31 and the rear rollers 2 can be formed integral with the roller bracket 3, constituting a module for installation in the roller-loaded zipper slide 1 subject to a scheduled production. After a purchase order is confirmed, modularized roller brackets can then be installed in respective roller-loaded zipper slides, and then respective pull tabs are respectively riveted to the crowns of respective roller-loaded zipper slides, enhancing quick delivery capacity.

FIGS. 9~16 illustrate a roller-loaded zipper slide 1 in accordance with a third embodiment of the present invention. This third embodiment is designed for use in a double-layer zipper, allowing the top and bottom interlocking teeth of the zipper tapes to be accurately guided into the internal chamber of the roller-loaded zipper slide 1. The roller-loaded zipper slide 1 of this third embodiment comprises a top slide body block 11, a bottom slide body block 12, a center block 13 connected between the top slide body block 11 and the bottom slide body block 12 (see FIGS. 13 and 15), an internal chamber 10 defined in between the top slide body block 11 and the bottom slide body block 12 (see FIGS. 9, 13 and 15), and a crown 14 located on the top side of the top slide body block 11 for holding a pull tab 8 (see FIG. 16).

The main features of the roller-loaded zipper slide 1 in accordance with this third embodiment are outlined hereinafter.

First and second roller brackets 3 are respectively fixedly mounted in the top slide body block 11 and bottom slide body block 12 of the roller-loaded zipper slide 1. The first and second roller brackets 3 each comprise a first or second roller 31 so configured that when the roller-loaded zipper slide 1 is attached to a double-layer zipper's zipper tapes 9' (see FIG. 16), the first and second front rollers 31 are kept in proximity to the double-layer zipper's top and bottom interlocking teeth 91 and in direct contact with the double-layer zipper's zipper tapes 9' (see FIGS. 9, 10, 13 and 15).

When the user pulls the pull tab 8 (see FIG. 16) and touches the front end of the crown 14, the rolling motion of the first and second front rollers 31 can guide the top and bottom interlocking teeth into the internal chamber 10 of the roller-loaded zipper slide 1. Further, the rolling contact between the first and second front rollers 31 and the double-layer zipper's zipper tapes 9' does not produce much friction resistance, avoiding scratching or damaging the stitches that fasten the top interlocking teeth 91' and the bottom interlocking teeth 92' to the respective zipper tapes 9', improving zipper slide sliding mobility, reducing zipper teeth wear and prolonging zipper slide lifespan.

Further, the front side 311 of the first front roller 31 of the roller bracket 3 is approximately kept in flush with or slightly protruding over the front edge 114 of the top slide body block 11, in proximity to the top interlocking teeth 91'. Further, the front side 312 of the second front roller 31 of the roller bracket 3 is approximately kept in flush with or slightly protruding over the front edge 124 of the bottom slide body block 12, in proximity to the bottom interlocking teeth 92'.

Figure 10:
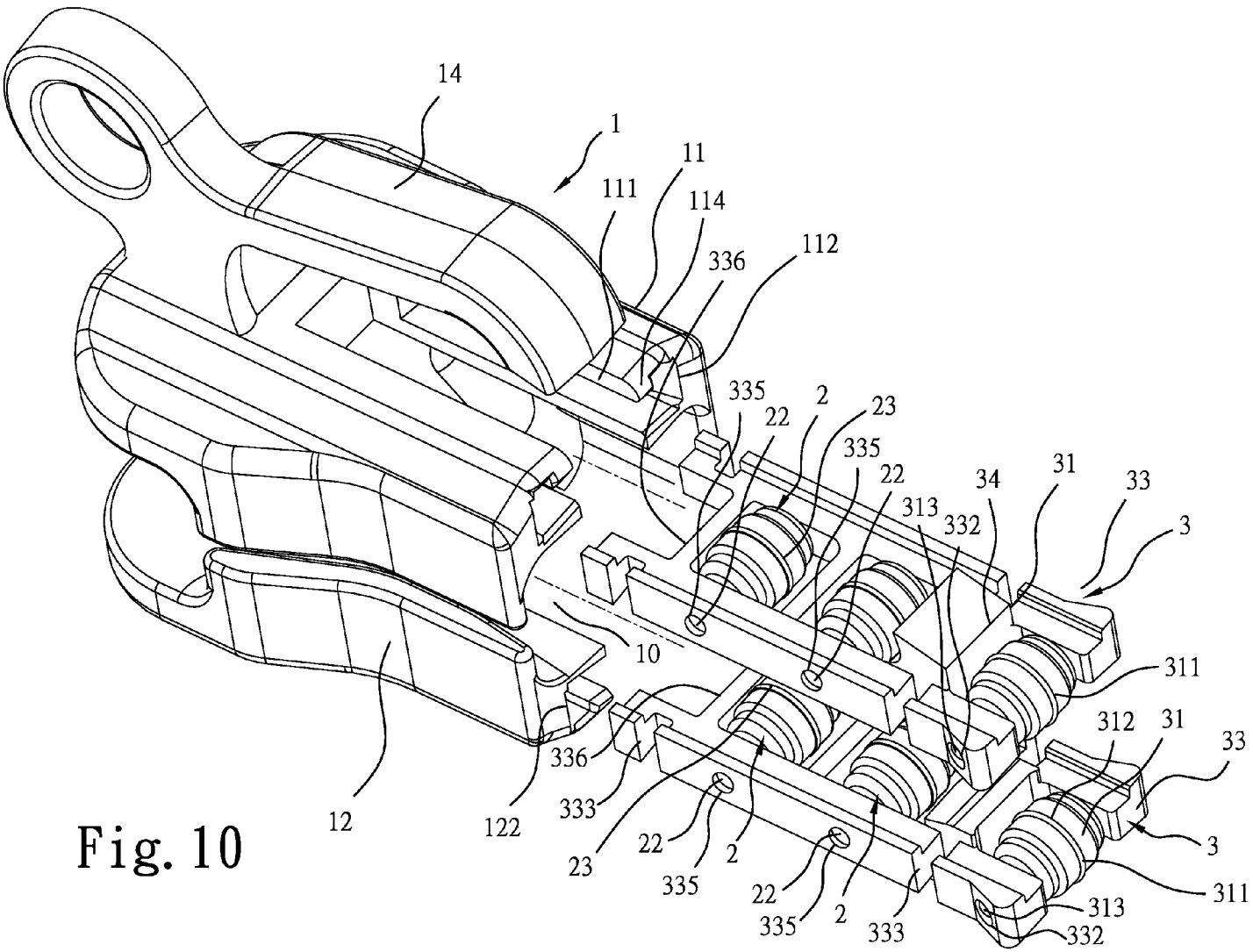
FIG. 10 is an exploded view of the roller-loaded zipper slide in accordance with the third embodiment of the present invention.
Figure 11:
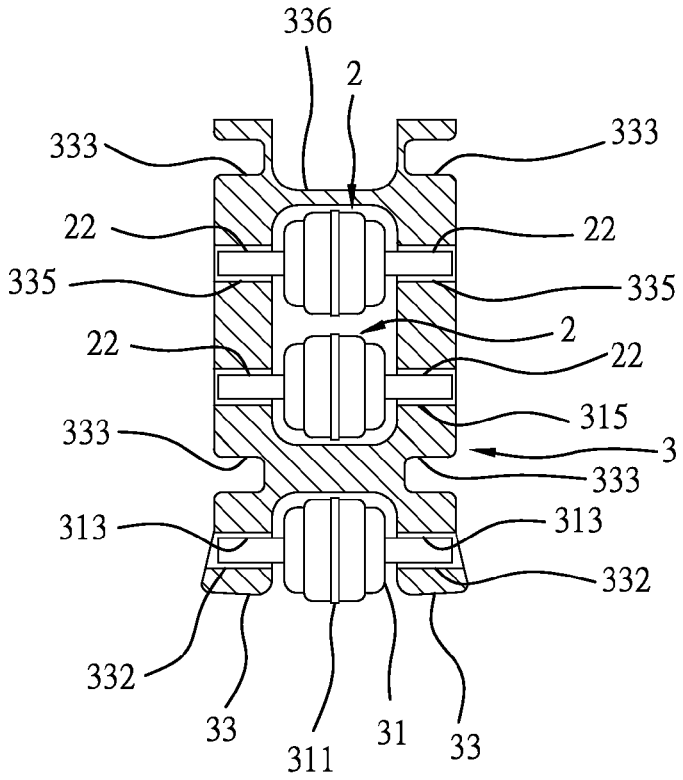
FIG. 11 is a sectional view of the roller bracket of the roller-loaded zipper slide in accordance with the third embodiment of the present invention.
Figure 12:
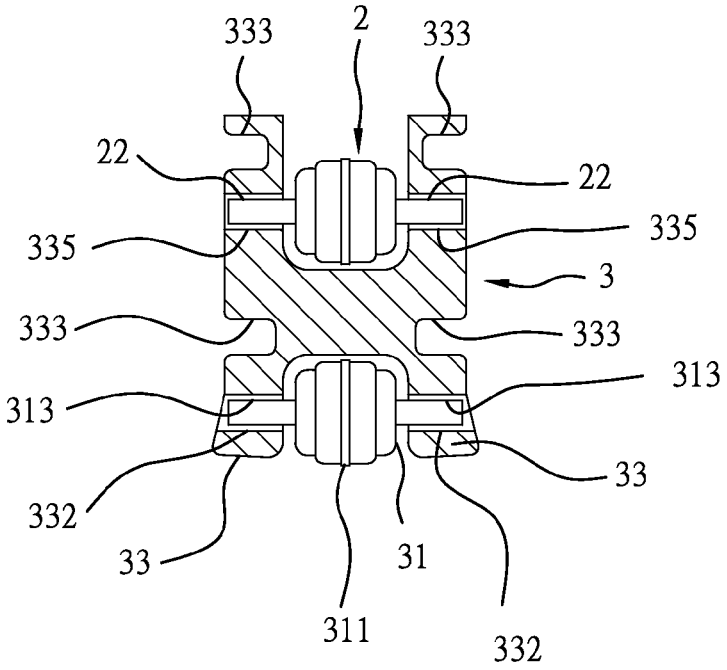
FIG. 12 corresponds to FIG. 11, illustrating an alternate form of the roller bracket.
Figure 14:
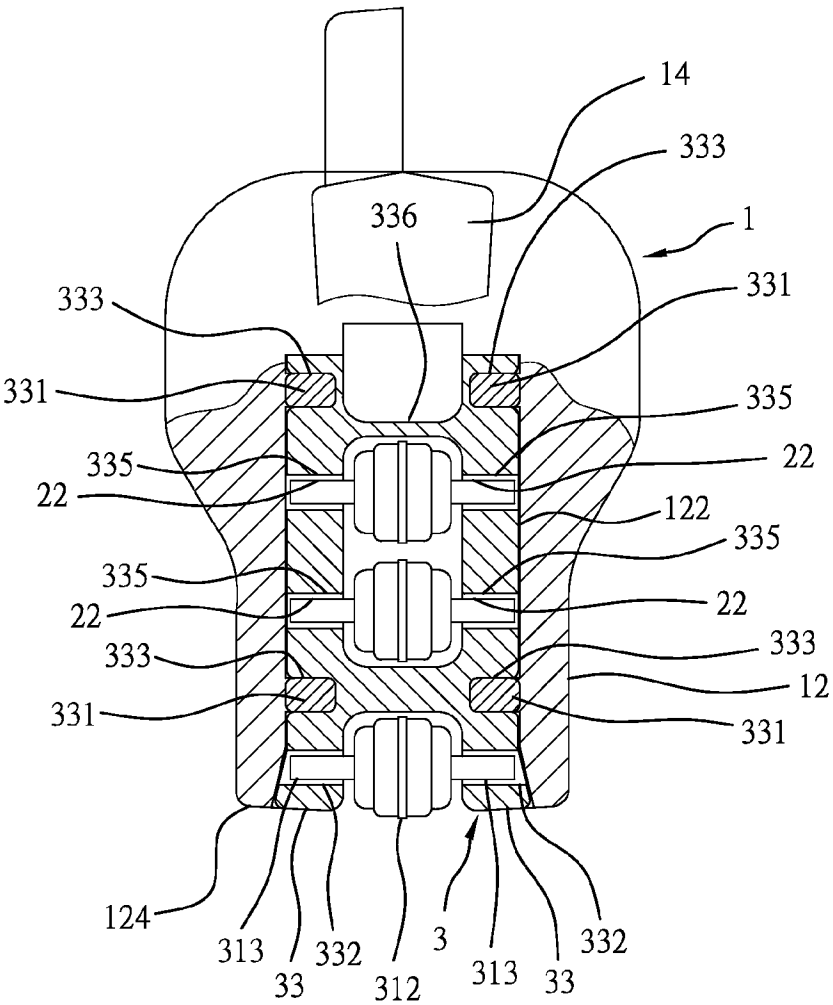
FIG. 14 is a top view, partially in section, of the roller-loaded zipper slide in accordance with the third embodiment of the present invention.

Further, in the aforesaid third embodiment, the top slide body block 11 comprises a first vertical slot 111 cut through the top and bottom sides thereof on the middle and two first coupling grooves 112 located at two opposite lateral sides of the first vertical slot 111 (see FIG. 10). Further, the first vertical slot 111 is kept in communication with the internal chamber 10. The first roller bracket 3 comprises two opposite rails 33 symmetrically disposed at two opposite lateral sides thereof and respectively coupled to the first coupling grooves 112 of the top slide body block 11 and then affixed thereto by riveting or any other fastening technique. Further, the bottom slide body block 12 comprises a second vertical slot 121 cut through the top and bottom sides thereof on the middle and two second coupling grooves 122 located at two opposite lateral sides of the second vertical slot 121 (see FIG. 10). Further, the second vertical slot 121 is kept in communication with the internal chamber 10. The second roller bracket 3 comprises two opposite rails 33 symmetrically disposed at two opposite lateral sides thereof and respectively coupled to the second coupling grooves 122 of the bottom slide body block 12 and then affixed thereto by riveting or any other fastening technique.

The first roller bracket 3 further comprises at least one, for example, two rear rollers 2 pivotally arranged in a parallel manner at a rear side relative to the first front roller 3. Each rear roller 2 of the first roller bracket 3 comprises a roller axle 22 pivotally connected between the two opposite rails 33 of the roller bracket 3 (see FIG. 10), and a bottom side 21 slightly projecting into the internal chamber 10 of the roller-loaded zipper slide 1 (see FIG. 15) right above the engaging position between the top interlocking teeth 91 of the left and right top zipper tapes 9'.

The second roller bracket 3 further comprises at least one, for example, two rear rollers 2 pivotally arranged in a parallel manner at a rear side relative to the second front roller 3. Each rear roller 2 of the second roller bracket 3 comprises a roller axle 22 pivotally connected between the two opposite rails 33 of the second roller bracket 3 (see FIG. 10), and a top side 23 slightly projecting into the internal chamber 10 of the roller-loaded zipper slide 1 (see FIG. 15) right beneath the engaging position between the bottom interlocking teeth 91 of the left and right top zipper tapes 9'.

Further, the first roller bracket 3 comprises a plurality of locating notches 333 symmetrically located at the two opposite rails 33 thereof (see FIG. 9) and affixed to the top slide body block 11 of the roller-loaded zipper slide 1 with rivets 331 or other fastening members. The roller bracket 3 further comprises a stop block 34 for stopping the pull tab 8 in the crown 14 of the roller-loaded zipper slide 1 after the crown 14 is riveted into a close position (see FIG. 16).

Further, the second roller bracket 3 comprises a plurality of locating notches 333 symmetrically located at the two opposite rails 33 thereof (see FIGS. 10 and 14) and affixed to the bottom slide body block 12 of the roller-loaded zipper slide 1 with rivets 331 or other fastening members.

Further, the first roller bracket 3 comprises two front pivot holes 332 and four rear pivot holes 335 symmetrically located at the two opposite rails 33 thereof (see also FIGS. 10, 11 and 14) for receiving the roller axle 313 of the first front roller 31 and the roller axles 22 of the first rear rollers 2. Further, the second roller bracket 3 comprises two front pivot holes 332 and four rear pivot holes 335 symmetrically located at the two opposite rails 33 thereof (see also FIGS. 10, 11 and 14) for receiving the roller axle 313 of the first front roller 31 and the roller axles 22 of the first rear rollers 2.

Figure 17:
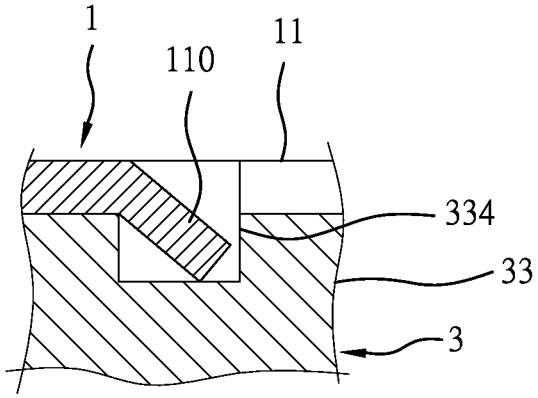
FIG. 17 is a schematic sectional view of a part of a roller-loaded zipper slide in accordance with a fourth embodiment of the present invention, illustrating the mounting arrangement between a top slide body block and a first roller bracket.
Figure 18:
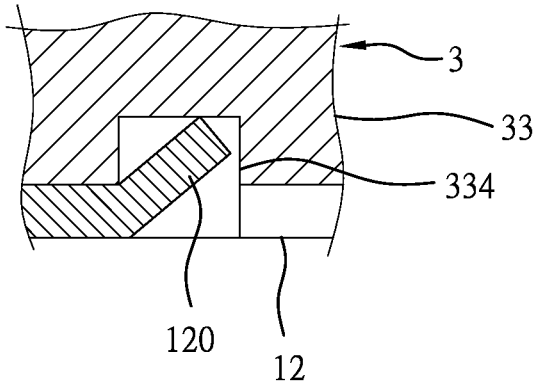
FIG. 18 is a schematic sectional view of a part of a roller-loaded zipper slide in accordance with the fourth embodiment of the present invention, illustrating the mounting arrangement between a bottom slide body block and a second roller bracket.

Referring to FIGS. 17 and 18, a roller-loaded zipper slide 1 in accordance with a fourth embodiment of the present invention is shown. This fourth embodiment is substantially similar to the aforesaid third embodiment with the exception that the roller-loaded zipper slide 1 of this fourth embodiment is characterized in that each rail 33 of the first and second roller bracket 3 comprises a protruding locating portion 110 or 120 riveted or stamped into engagement with a respective locating recess 334 at the corresponding rail 33 of the first or second roller bracket 3.

Figure 13:
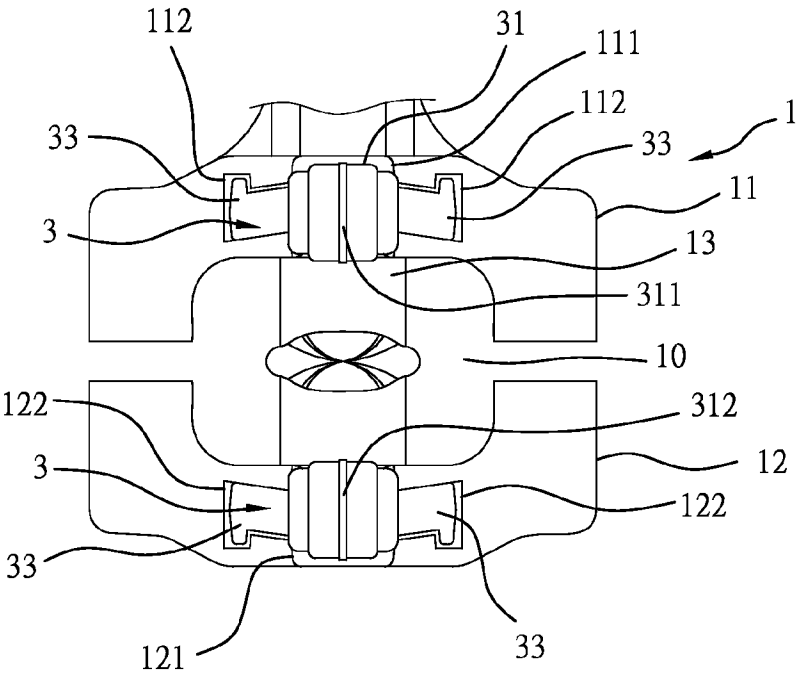
FIG. 13 is a schematic front view of the roller-loaded zipper slide in accordance with the third embodiment of the present invention.
Figure 15:
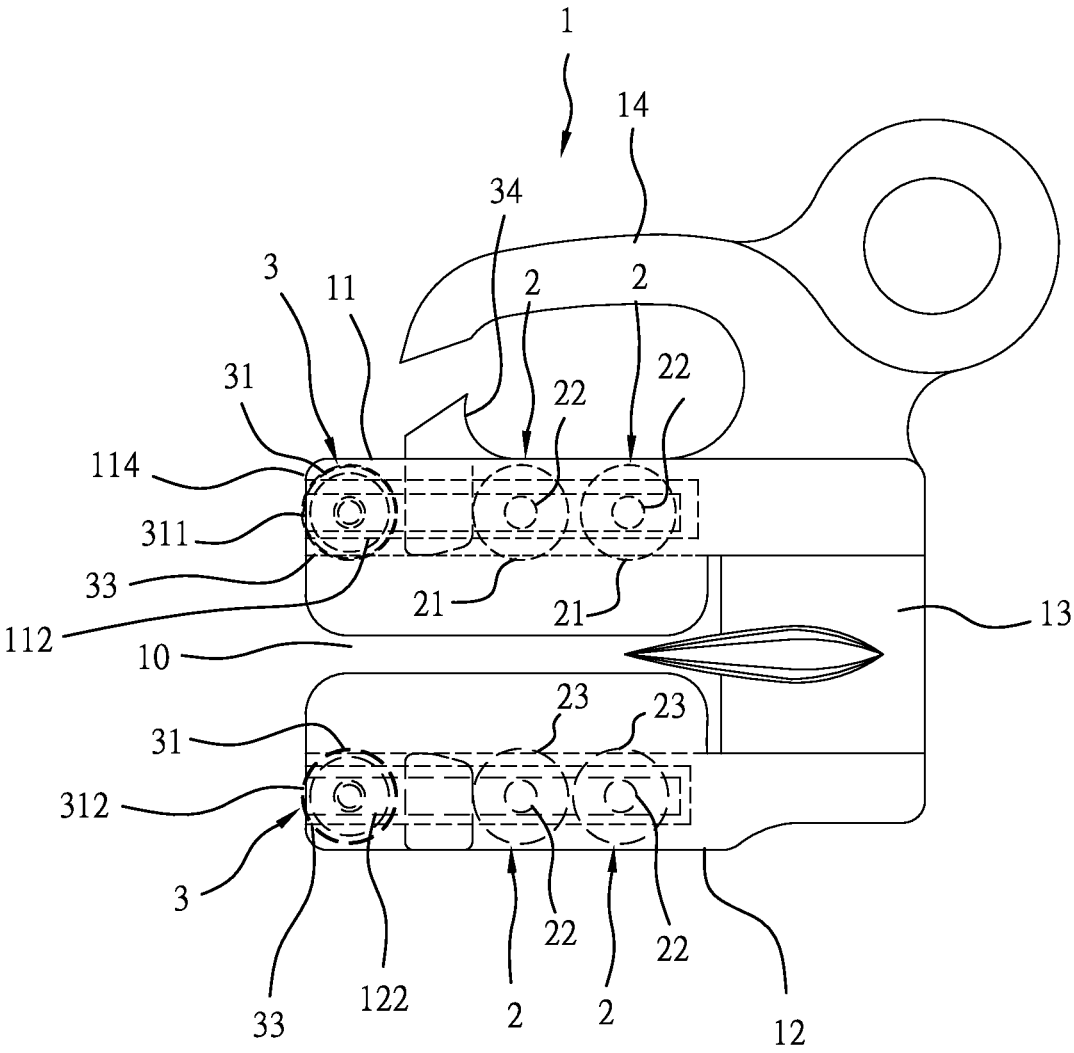
FIG. 15 is a schematic side view of the roller-loaded zipper slide in accordance with the third embodiment of the present invention.
Figure 16:
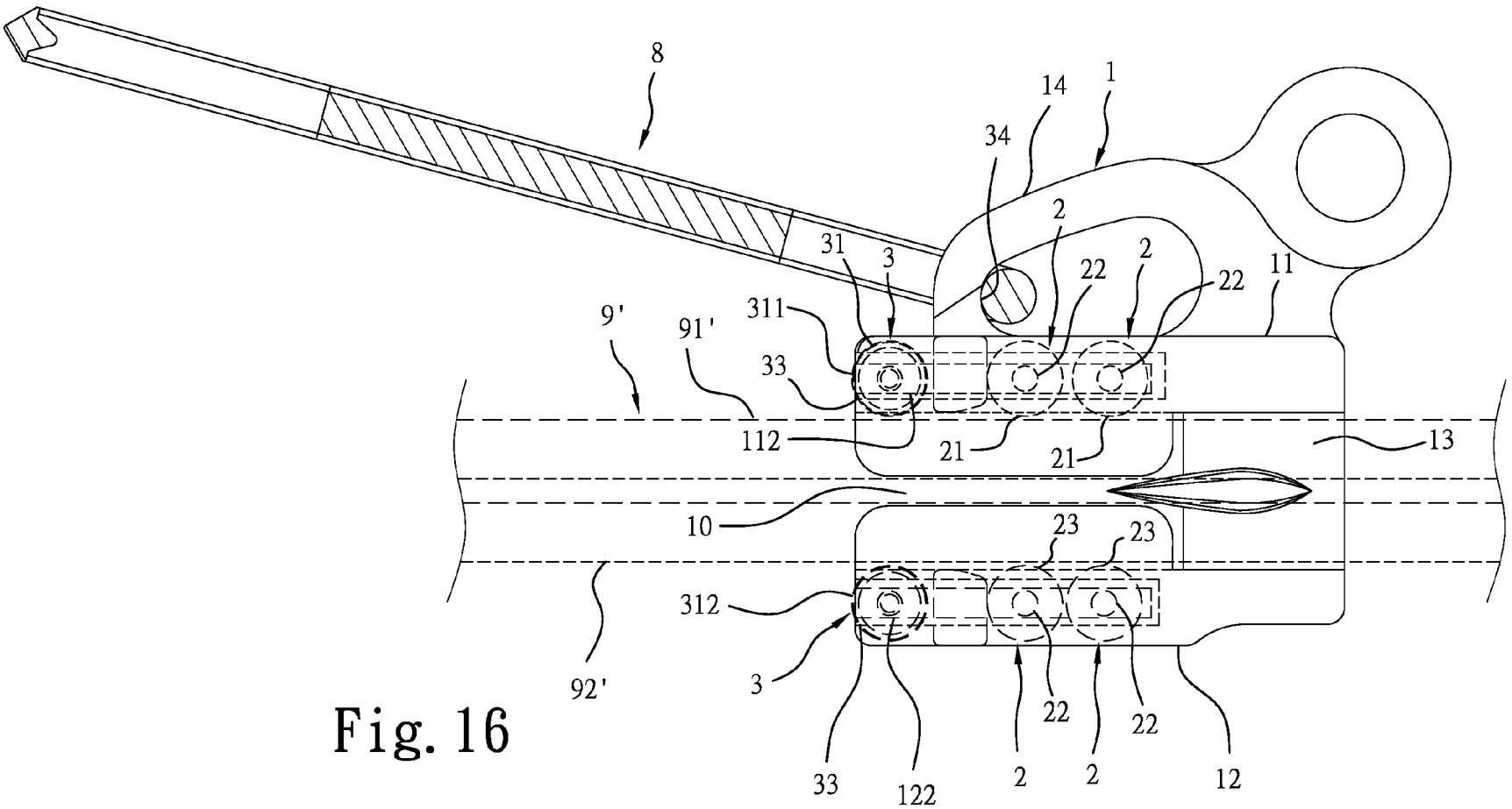
FIG. 16 is a schematic applied view of the third embodiment of the present invention, illustrating a pull tab fastened to the crown and the crown set in position.

Further, in the aforesaid third embodiment as shown in FIG. 13, the first roller bracket 3 can be configured to provide one front roller 31 and one rear roller 2 only. The roller axle 313 of the front roller 31 and the roller axle 22 of the rear roller 2 of the first roller bracket 3 are respectively pivotally coupled to respective front pivot holes 332 and rear pivot holes 335 at the rails 33 of the first roller bracket 3.

Further, the aforesaid first and second roller brackets 3 each comprise a plurality of transverse arms 336 connected between the respective rails 33 (see FIGS. 10 and 11) to enhance the structural strength.

Figure 19:
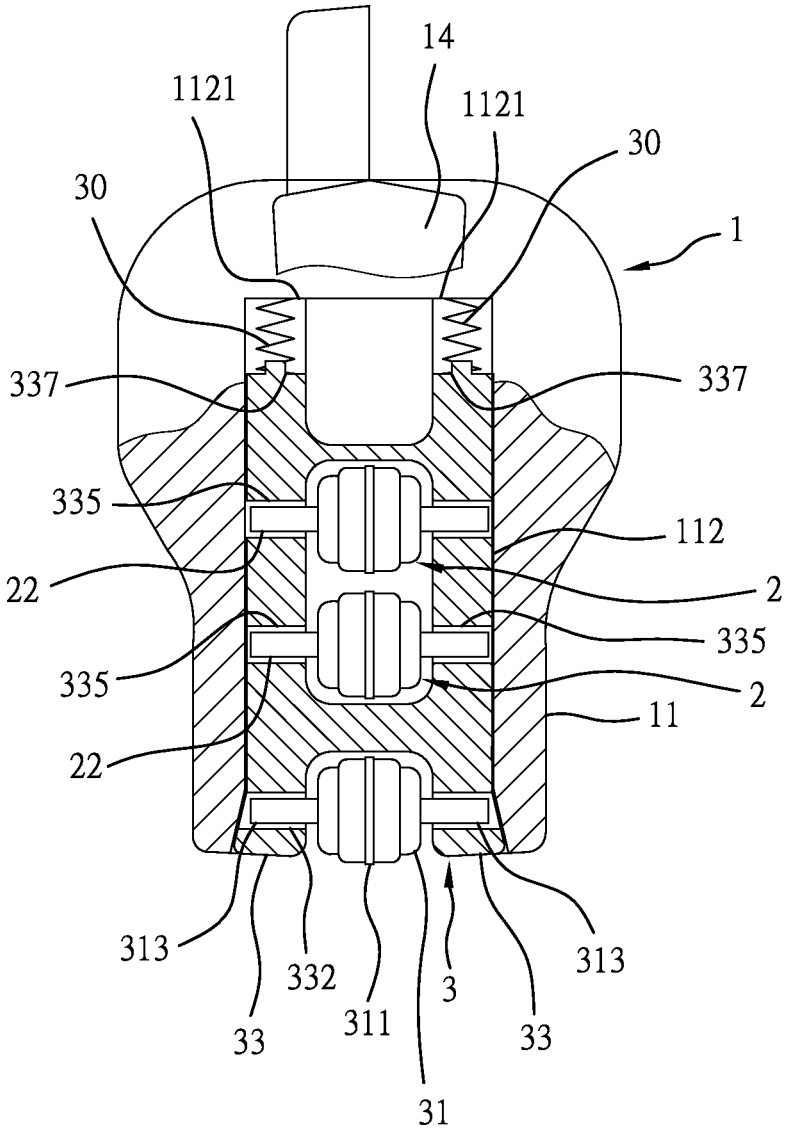
FIG. 19 is a top view, partially in section, of a roller-loaded zipper slide in accordance with a fifth embodiment of the present invention.
Figure 20:
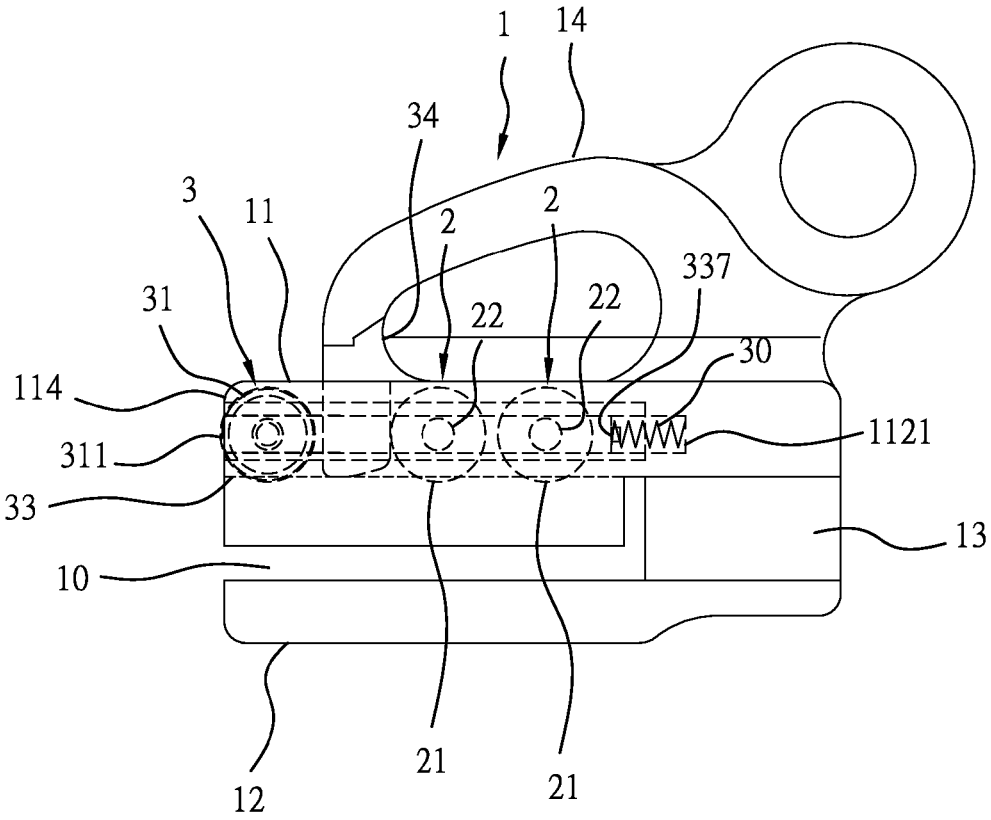
FIG. 20 is a sectional side view of the roller-loaded zipper slide in accordance with the fifth embodiment of the present invention.
Figure 21:
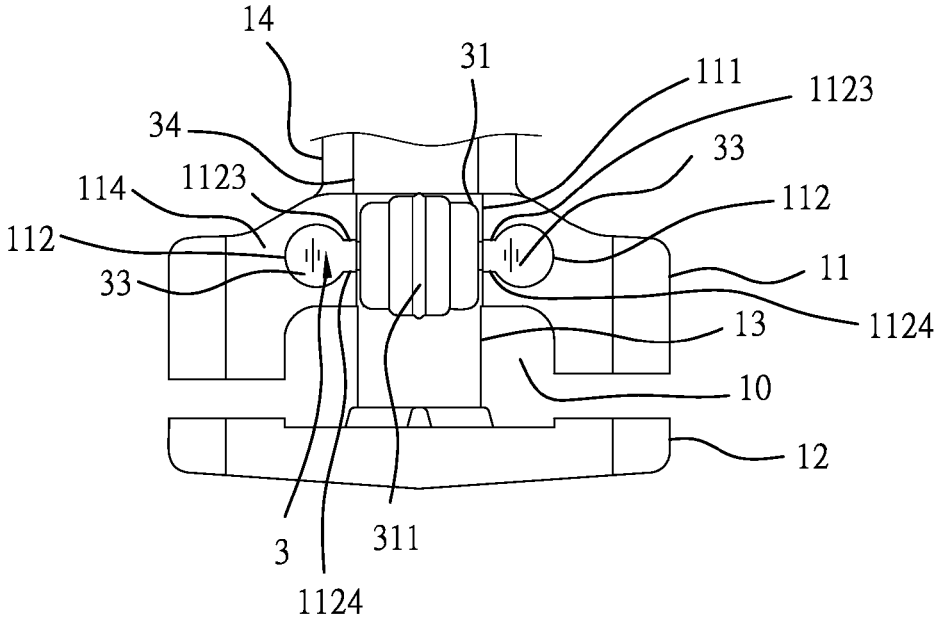
FIG. 21 is a sectional front view of the roller-loaded zipper slide in accordance with the fifth embodiment of the present invention.

Referring to FIGS. 19-21, a roller-loaded zipper slide 1 in accordance with a fifth embodiment of the present invention is shown. This fifth embodiment is substantially similar to the aforesaid first and third embodiments with the exception that the pull tab is replaceable. According to this fifth embodiment, spring members 30 are connected between the rear ends 337 of the rails 33 of the roller bracket 3 and the rear ends 1121 of the coupling grooves 112 of the top slide body block 11 (see FIG. 20); the front top edge 1123 and front bottom edge 1124 of each coupling groove 112 of the top slide body block 11 of the roller-loaded zipper slide 1 are flanged to stop the rails 33 in the respective coupling grooves 112; the crown 14 is partially punched down and forced into engagement with the stop block 34 of the roller bracket 3, stopping the roller bracket 3 in position. When the roller bracket 3 is pushed back to compress the spring members 30, a gap is left between the crown 14 and the top slide body block 11, allowing removal of the pull tab (not shown) for a replacement.

In conclusion, the invention provides a roller-loaded zipper slide for zip fastener, which has the advantages and features as follows:

1. The roller-loaded zipper slide 1 comprises at least one roller bracket 3 each carrying a front roller 31, thus, when attaching the roller-loaded zipper slide 1 to the zipper tapes 9;9' of a single layer or double-layer zipper, the front roller 31 is kept in proximity to the zipper's interlocking teeth 91;91';92 and in direct contact with the zipper tapes 9;9' to guide the interlocking teeth 91;91';92 into the internal chamber 10 of the roller-loaded zipper slide 1 smoothly and accurately, avoiding scratching or damaging he stitches that fasten the interlocking teeth 91;91';92 to the zipper tapes 9;9', improving sliding mobility, reducing zipper teeth wear and prolonging zipper slide lifespan.
2. The roller-loaded zipper slide 1 can be assembled subject to a scheduled production. After a purchase order is confirmed, roller brackets can then be installed in respective roller-loaded zipper slides, and then respective pull tabs can be respectively riveted to the crowns of respective roller-loaded zipper slides, enhancing quick delivery capacity.

3. The front roller 31 and the rear rollers 2 can be formed integral with the roller bracket 3, constituting a module for installation in the roller-loaded zipper slide 1 conveniently.

4. The front roller 31 and rear rollers 2 of the roller bracket 3 are positively secured in position for free rotation, and configured to avoid direct contact with the stitches that are fastened to the zipper tapes 9;9' to secure the interlocking teeth 91;91';92 in place, preventing damaging the stitches.

5. The front roller 31, the rear rollers 2 and the roller bracket 3 can be made in integrity by die casting, facilitating electroplating and assuring a high level of operating precision.

What is claimed is:

1. A roller-loaded zipper slide used in a zip fastener, comprising a top slide body block, a bottom slide body block, a center block connected between said top slide body block and said bottom slide body block, an internal chamber defined in between said top slide body block and said bottom slide body block, and a crown located on a top side of said top slide body block and holding a pull tab;

wherein the roller-loaded zipper slide further comprises a roller bracket fixedly mounted in said top slide body block, said roller bracket comprising:

at least one front roller pivotally mounted therein at a front side thereof, each said front roller having a front side kept in flush with a front edge of said top slide body block, wherein said to slide body block comprises two coupling grooves horizontally disposed therein at two opposite sides in a parallel manner; said roller bracket comprises two opposite rails respectively inserted into said coupling grooves, and a plurality of locating notches symmetrically located at said rails and affixed to said top slide body block with fastening members.

2. The roller-loaded zipper slide as claimed in claim 1, wherein said roller bracket further comprises at least one rear roller pivotally mounted therein at a rear side relative to said at least one front roller configured to be above interlocking teeth of said zip fastener, each said roller having a bottom side projecting into said internal chamber.

3. The roller-loaded zipper slide as claimed in claim 1, wherein said roller bracket further comprises an upwardly arched stop block adapted to stop said pull tab in said crown.

4. The roller-loaded zipper slide as claimed in claim 1, wherein said roller bracket and said at least one front roller are so configured that each said front roller is kept in proximity to the interlocking teeth of said zip fastener and in direct contact with zipper tapes of said zip fastener, enabling the rolling motion of said at least one front roller to guide the interlocking teeth of said zip fastener into said internal chamber.

5. The roller-loaded zipper slide as claimed in claim 1, wherein said top slide body block further comprises a vertical slot cut through top and bottom sides thereof between said coupling grooves and kept in communication with said internal chamber.

6. The roller-loaded zipper slide as claimed in claim 1, further comprises a plurality of spring members connected between respective rear ends of said rails of said roller bracket and respective rear ends of said coupling grooves of said top slide body block;

each said coupling groove comprises a flanged front top edge and a flanged front bottom edge adapted to stop said rails of said roller bracket in said coupling grooves;

said roller bracket further comprises an upwardly arched stop block;

said crown is kept in engagement with said upwardly arched stop block of said roller bracket to stop said roller bracket in said coupling grooves.

7. A roller-loaded zipper slide used in a zip fastener, comprising a top slide body block, a bottom slide body block, a center block connected between said top slide body block and said bottom slide body block, an internal chamber defined in between said top slide body block and said bottom slide body block, and a crown located on a top side of said top slide body block and holding a pull tab;

wherein the roller-loaded zipper slide further comprises a first roller bracket fixedly mounted in said top slide body block and a second roller bracket fixedly mounted in said bottom slide body block, said first roller bracket comprising at least one first front roller pivotally mounted therein at a front side thereof, each said first front roller having a front side kept in flush with a front edge of said top slide body block, said second roller bracket comprising:

at least one second front roller pivotally mounted therein at a front side thereof, each said second front roller having a front side kept in flush with a front edge of said bottom slide body block, wherein said first roller bracket, said second roller bracket and said at least one first front roller and said at least one second front roller are so configured that each said first front roller and each said second front roller are kept in proximity to the interlocking teeth of said zip fastener and in direct contact with zipper tapes of said zip fastener, enabling the rolling motion of said at least one first front roller and said at least one second to guide the interlocking teeth of said zip fastener into said internal chamber;

said top slide body block and said bottom slide body block each comprise two coupling grooves horizontally disposed therein at two opposite sides in a parallel manner;

said first roller bracket and said second roller bracket each comprise two opposite rails respectively inserted into said coupling grooves of said top slide body block and said bottom slide body block, and a plurality of locating notches symmetrically located at the rails thereof and affixed to said top slide body block and said bottom slide body block with respective fastening members; said first roller bracket further comprises an upwardly arched stop block adapted to stop said pull tab in said crown.

8. The roller-loaded zipper slide as claimed in claim 7, wherein said first roller bracket further comprises at least one rear roller pivotally mounted therein at a rear side relative to said at least one first front roller above the interlocking teeth of said zip fastener, each rear roller of said first roller bracket having a bottom side projecting into said internal chamber;

said second roller bracket further comprises at least one rear roller pivotally mounted therein at a rear side relative to said at least one second front roller beneath the interlocking teeth of said zip fastener, each rear roller of said second roller bracket having a top side projecting into said internal chamber.

9. A roller-loaded zipper slide used in a zip fastener, comprising a top slide body block, a bottom slide body block, a center block connected between said top slide body block and said bottom slide body block, an internal chamber defined in between said top slide body block and said bottom slide body block, a crown located on a top side of said top slide body block and holding a pull tab; and wherein the roller-loaded zipper slide further comprises a roller bracket fixedly mounted in said top slide body block, said roller bracket comprising at least one front roller pivotally mounted therein at a front side thereof, each said front roller having a front side kept in flush with a front edge of said top slide body block, a plurality of spring members connected between respective rear ends of said rails of said roller bracket and respective rear ends of said coupling grooves of said top slide body block;

each said coupling groove comprises a flanged front top edge and a flanged front bottom edge adapted to stop said rails of said roller bracket in said coupling grooves;

said roller bracket further comprises an upwardly arched stop block;

said crown is kept in engagement with said upwardly arched stop block of said roller bracket to stop said roller bracket in said coupling grooves.

* * * * *